US006412991B1

(12) United States Patent
Klinefelter et al.

(10) Patent No.: US 6,412,991 B1
(45) **Date of Patent: *Jul. 2, 2002**

(54) IDENTIFICATION CODE FOR COLOR THERMAL PRINT RIBBON

(75) Inventors: Gary M. Klinefelter; Gary A. Lenz, both of Eden Prairie, MN (US)

(73) Assignee: Fargo Electronics, Inc., Eden Prairie, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/309,391

(22) Filed: May 10, 1999

Related U.S. Application Data

(60) Provisional application No. 60/111,485, filed on Dec. 7, 1998.

(51) Int. Cl.[7] ..... B41J 31/00

(52) U.S. Cl. ..... 400/240; 400/240.4; 347/177; 347/178

(58) Field of Search ..... 347/177, 178; 400/237, 240, 240.3, 596, 599, 521, 611, 613, 618, 207 E, 240.4

(56) References Cited

U.S. PATENT DOCUMENTS

| | | | | | |
|---|---|---|---|---|---|
| 4,458,253 | A | * | 7/1984 | Goff, Jr. et al. | 347/176 |
| 4,496,955 | A | | 1/1985 | Maeyama et al. | 346/76 |
| 4,573,059 | A | * | 2/1986 | Shinma et al. | 400/240.4 |
| 4,614,950 | A | * | 9/1986 | Ito | 347/178 |
| 4,630,069 | A | | 12/1986 | Erlichman | 346/76 |
| 4,667,208 | A | * | 5/1987 | Shiraki et al. | 347/177 |
| 4,687,359 | A | | 8/1987 | Barrus et al. | 400/218 |
| 4,970,531 | A | | 11/1990 | Shimizu et al. | 346/76 |
| 5,009,531 | A | | 4/1991 | Koike | 400/240.3 |
| 5,037,218 | A | | 8/1991 | Shimizu et al. | 400/237 |
| 5,101,222 | A | * | 3/1992 | Hakkaku | 347/175 |
| 5,104,247 | A | | 4/1992 | Ohshima | 400/240.3 |
| 5,144,331 | A | | 9/1992 | Amano | 346/1.1 |
| 5,152,625 | A | * | 10/1992 | Machii | 400/711 |
| 5,162,816 | A | | 11/1992 | Yorozu | 346/76 |
| 5,185,315 | A | * | 2/1993 | Sparer | 400/240.3 |
| 5,305,020 | A | * | 4/1994 | Gibbons et al. | 347/177 |
| 5,413,425 | A | | 5/1995 | Park | 400/240.3 |
| 5,480,237 | A | | 1/1996 | Tanahashi | 400/120.02 |
| 5,501,537 | A | * | 3/1996 | Kohno | 400/240.4 |
| 5,534,890 | A | * | 7/1996 | Krug et al. | 347/194 |
| 5,636,926 | A | * | 6/1997 | Yamaguchi | 400/120.02 |
| 5,711,625 | A | * | 1/1998 | Takahashi | 400/582 |
| 5,718,523 | A | * | 2/1998 | Shiina et al. | 400/120.04 |
| 5,755,519 | A | | 5/1998 | Klinefelter | 400/249 |
| 5,769,549 | A | | 6/1998 | Kouzai et al. | 400/240.4 |
| 5,781,219 | A | * | 7/1998 | Kouzai et al. | 347/178 |
| 5,803,627 | A | * | 9/1998 | Paranjpe | 400/240 |
| 5,853,255 | A | * | 12/1998 | Soshi et al. | 400/240 |
| 5,978,005 | A | * | 11/1999 | Hadley | 347/177 |
| 5,982,405 | A | * | 11/1999 | Sasaki et al. | 347/176 |

FOREIGN PATENT DOCUMENTS

| | | | | |
|---|---|---|---|---|
| EP | 0 555 834 A2 | | 2/1993 | |
| EP | 0 566 058 A2 | | 4/1993 | |
| EP | 561347 | * | 9/1993 | 400/240 |
| JP | 2-139272 | * | 5/1990 | |
| JP | 4-31080 | * | 2/1992 | 400/240 |
| JP | 4-44882 | * | 2/1992 | 400/240 |
| WO | WO 95/24316 | | 9/1995 | |

* cited by examiner

*Primary Examiner*—Daniel J. Colilla
(74) *Attorney, Agent, or Firm*—Westman, Champlin & Kelly, P.A.

(57) ABSTRACT

A ribbon for a thermal printer has a series of frames of different colors in a sequence that are correlated to the position of cards to be printed. The ribbon has indexing marks for each frame and also indicators for each repeating sequence of frames. The index marks are arranged in a line across the ribbon and the marks can be coded to individually indicate the color or other characteristic of the frame associated with the line of index mark. This information is received by a controller to control various printer functions.

16 Claims, 4 Drawing Sheets

IDENTIFICATION CODE FOR COLOR THERMAL PRINT RIBBON

CROSS REFERENCE TO RELATED APPLICATION

Reference is made to the U.S. Provisional Patent Application Ser. No. 60/111,485, filed Dec. 7, 1998.

BACKGROUND OF THE INVENTION

The present invention relates to an identification coding for print ribbons and other ribbons or webs that have individual segments or panels that are different from other segments and must be positively identified for desired operations in a printer or other apparatus. In particular the coding is used between groups of colors on a color printing ribbon and also between individual frames of different colors, which gives individual controls for a wide variety of functions.

The thermal print ribbons that are presently used in thermal printers are divided into different color dye carrying frames, panels, blocks or segments. Thermal printers require a sensing system, which is capable of identifying the location of the individual colored panel or frames of the web or ribbon used, as well as the start of each group or sequence of the color dye panels or frames.

The ribbon is held against a platen that is rotatable, and the ribbon moves with the platen during printing, when a thermal printing head engages the ribbon and causes transfer of a colored dye onto a card or substrate positioned between the ribbon and the platen, and which is also moving with the platen. The printing sequence is carried out under a central control that receives signals indicating the presence of a card or other substrate on which the information is to be printed, and also receiving signals indicating what color frame of the ribbon is in position under the print head and for lining up or registering the card and ribbon.

In the past, index marks had been used along the side edges of the ribbon for indicating when the sequence of different color frames starts and is repeated, and also to indicate the boundaries between adjacent frames of different colors of transferrable dye material. In operation the web is advanced until an index mark is detected to indicate that a transferrable color material is in position for printing.

The ribbon or web is advanced and rewound under control of the printer controller for one group or sequence of repeatable frames, to obtain the desired image on the card using the dyes on the ribbon or web. The operation is carried out a predetermined number of times so the same sequence of frames is used for printing multiple color images. After an entire sequence of frames is used for printing a color image, the web is advanced until an index mark is sensed for the next sequence of colored frames, thereby bringing the beginning of a sequence of frames in position for printing.

SUMMARY OF THE INVENTION

The present invention relates to an identification coding for a web or ribbon using laterally extended code markings between each of the color frames or segments on the ribbon that are sequenced along the ribbon length. The code is preferably in the form of readable printed dots, dashes or bars that extend laterally across the web or strip of ribbon at the start of the ribbon, between individual frames or segments, and also between repeating groups or sequences of frames. The code location and arrangement permits a wide range of identification marks to be sensed for determining the ribbon lot and dye set marks at the start of a ribbon and to indicate the color of a following frame or panel on the ribbon. These marks can be used to set the printhead controls, to adjust the printhead for ribbon density, type of color layers and similar known variables. Also, the code provides information to insure the correct ribbon or web is installed. The ribbon can also be identified by a discrete code to register the web or ribbon to a particular card printer. By using sensors to determine ribbon velocity or tension can be controlled to compensate for ribbon stretch, thus also permitting compensating or changing the ribbon tension for accommodating panel to panel variations. The code location permits determining when the leading edge of the known, repeating group, series or sequence of frames is sensed, as well.

The code selected permits a variety of printing techniques for the application of the code and also permits a wide variety of sensors for decoding. Light signals are used in one embodiment using a known source of light, and known sensor arrays that provide digital signals to the controller indicating the information about the following frames. With present sensors the presence or absence of a mark in a particular location of the sensed image provides a digital indication of the applied code and the resolution is adequate to provide more information than that needed for color printers.

In one form, the laterally extending code strips can be formed with white ink marks so a reflected light signal will be used. Sense and receive sensors can be on the same side of the ribbon. The operator can provide codes for many different conditions, since the laterally extending bands or marks provide a substantial space for such coded information. The coded information at the start of a ribbon can indicate whether the ribbon or web is compatible with the printer in which it is installed and thus different compatibilities of ribbons can be created to give different customers proprietary ribbon.

A further aspect of having markings for each individual color panel or frame is to use the color signal, which may indicate a color having different densities from other colors, to provide a feedback to the printhead power control for adjustment of the printhead power to suit the color being printed.

DETAILED DESCRIPTION OF THE PREFERRED EMBODIMENTS

Figure 1:
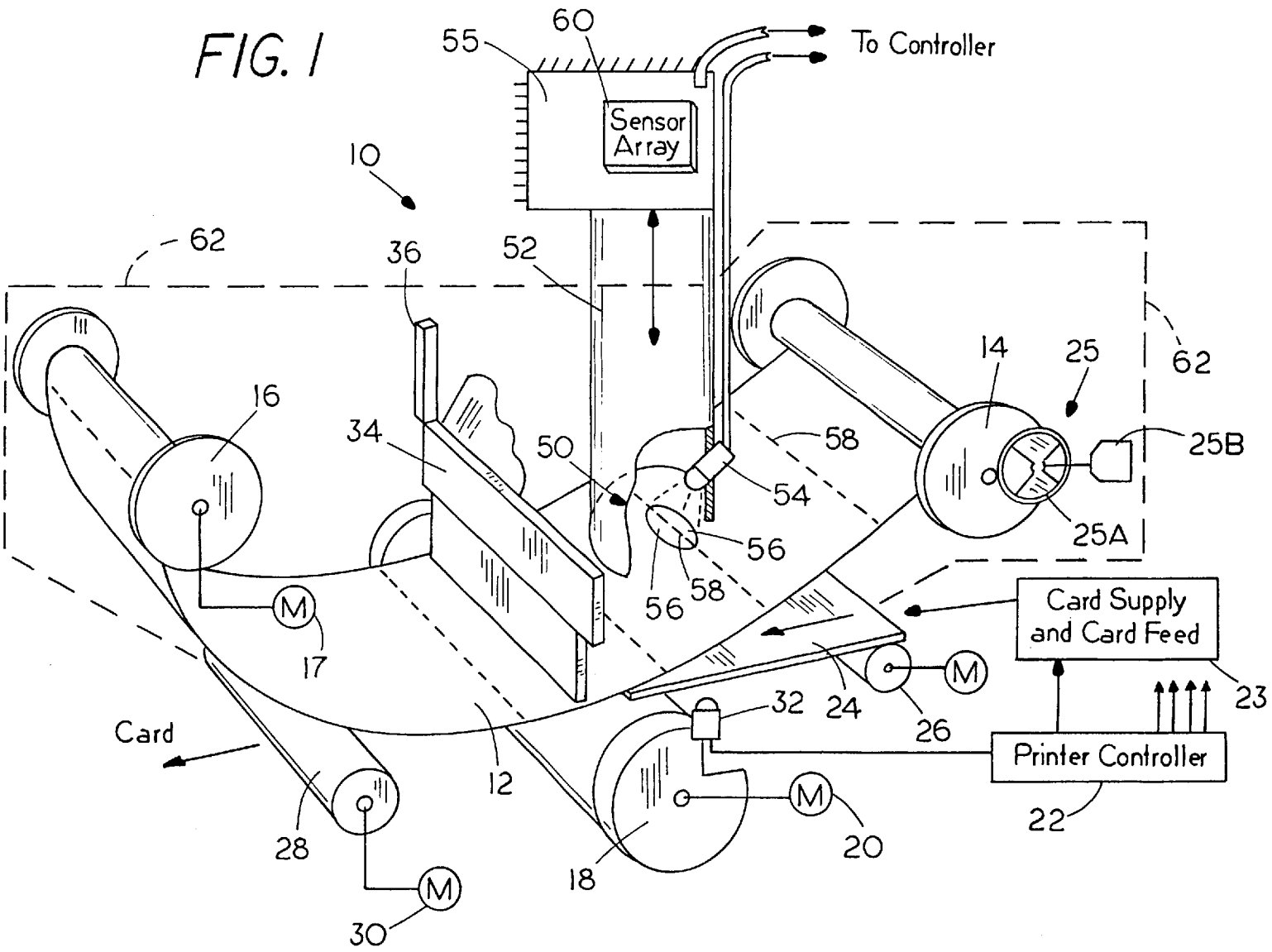
FIG. 1 is a schematic representation of a thermal printer head and ribbon shown in use with an index code and code sensor made according to an embodiment of the invention.

FIG. 1 is a schematic representation of a printer 10 using a strip or web of ribbon 12 that is provided from a supply roll 14 and extends to a take-up roll 16, and passes over a rotatable and driven printing platen 18. The platen is rotatably driven by a motor 20 under central control from a printer controller 22.

The ribbon take up roller 16 is driven by a motor 17, which also can be synchronized with a drive for the supply roller and controlled by the printer controller 22.

A card or substrate of any desired kind on which color images are to be printed is indicated at 24 and is provided from a card supply and card feed 23 in a conventional manner. The card 24 is supported on and driven in its path by suitable drive and guide rollers 26 and 28 at the input and output ends of the platen 18. The drive and guide rollers 26 and 28 can be driven in unison through suitable motors 30, under control from the printer controller 22. Spring loaded pinch rollers can be used with rollers 26 and 28, in a conventional manner as well for controlling movement of the card 24.

As the card 24 approaches the platen 18 in a sequence of operations for printing information on the card, a card sensor 32 will sense the leading edge of the card to provide position information back to the printer controller 22 for operation and proper timing with the ribbon and print head.

A printer web or ribbon supply velocity sensor is also shown, so that the velocity of the web or ribbon coming off the printer web or ribbon supply roller 14 is known. The velocity sensor shown at 25 includes a typical rotating disc 25A driven by the supply roll as it rotates, and an encoder or sensor 25B that provides pulses indicating the speed of rotation of the web or ribbon supply roll 14. By correlating the rotational information with the amount of ribbon remaining, which can be done by counting the frames or panels that come off the supply roll, the velocity of the ribbon is provided as a signal from the sensor 25B.

A conventional thermal print head 34 is supported on a suitable frame 36 and is aligned with the platen 18 in a normal manner. The print ribbon or web 12 passes underneath the print head and above the platen 18. The ribbon or web is in registry with the card 24 on which printing is to take place, as the card moves with the platen between the print head and the platen. The ribbon also moves with the card 24 and platen 18. The platen 18 is on the opposite side of the card 24 from the print web or ribbon.

Figure 2:
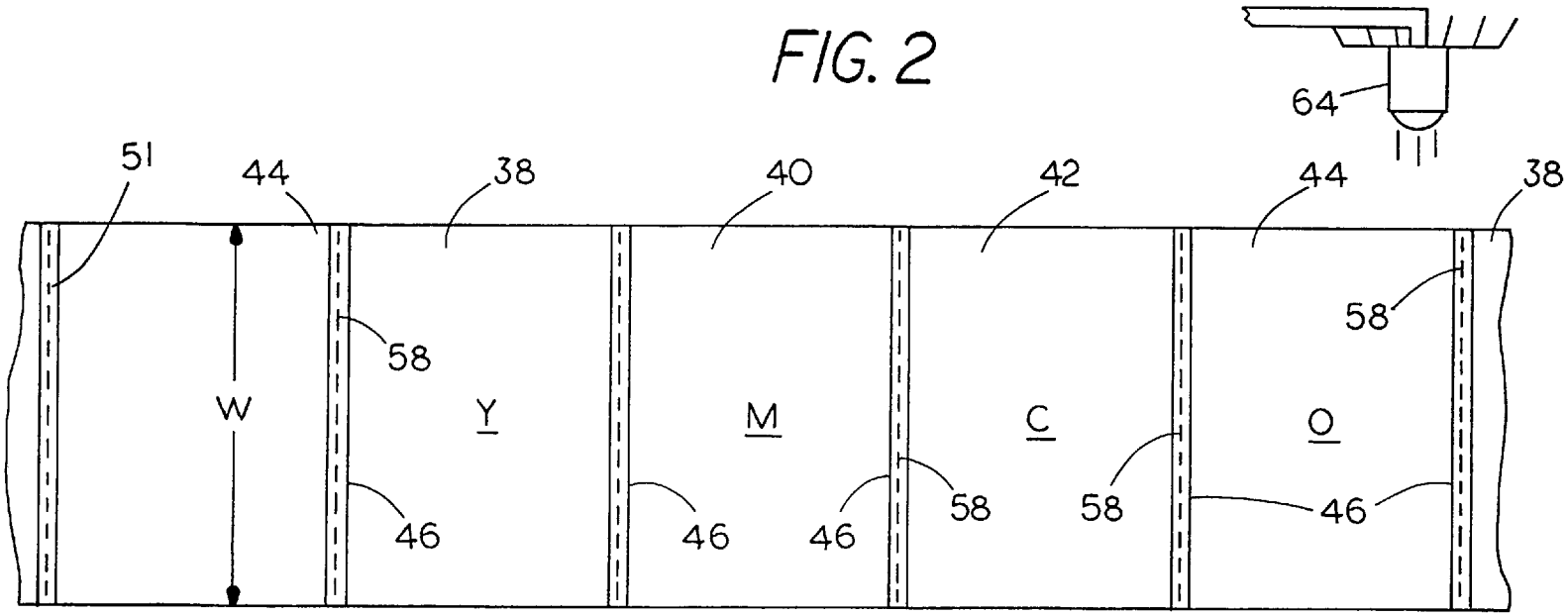
FIG. 2 is a plan view of a typical segment of frames of a thermal dye transfer ribbon have an information code shown thereon.

The print ribbon 12 is shown as a thermal dye sublimation or resin ribbon that is divided up into individual, different color frames, panels or segments along its length. These frames or panels repeat in a sequence or group. For example, as shown in FIG. 2, a yellow frame or panel is indicated at 38 and by Y. Panel 38 is followed by a magenta frame or panel 40 represented as M. A cyan frame or panel 42 is represented at C, and a clear or see-through frame or panel 44 is represented as O. These colors then repeat in the next series of frames. In addition, a black resin frame or panel can be provided in the sequence of the colored frames, if desired.

In the present invention, the print ribbon width is known, as indicated by W in FIG. 2, and at the end of each individual frame or panel, and thus the beginning of each of the next individual different colored frames or panels, there is a band 46 indicated on which an index or code line 58 is printed or otherwise recorded, thereby providing indexing marks or coding. The term marks or indicia as used herein means one or more or a series of printed dots, dashes or lines that are spaced in a manner compatible with a sensor array so that the presence or absence of a mark in a particular region of the indexing or coding line will provide significant information about the following frame or frames (or panels) on the ribbon. When the position and sequence of the marks are determined, the marks will identify the following frames or sequence of frames or panels from a coding scheme selected by the user.

At the lead in end of the ribbon, there is a code band or line 51 (see FIG. 2) that is used for providing coded information relating to the web or ribbon characteristics, so that the "lot" of the ribbon is indicated right on the ribbon or web itself, and the dye set used for preparing the web is also provided, so the characteristics of the colored frames or panels can be determined. This information from the code band 51 is sensed by suitable sensors that are used, as will be discussed, and can provide signals back to the controller 22 so that the power provided along a power connection indicator at 37 can be carried to the printhead 34 initially as a function of the coded information of the band 51. If the dye set is of a character that requires more power or more heat to provide an adequate transfer, the power to the print head can be adjusted to provide additional power (or less power) to heaters in the printhead as needed.

The code band 51 can also be used for providing data for insuring that the ribbon or web is compatible with the printer in which it is to be installed, so that there is no error in introducing the ribbon into the printer itself.

The marks used for the code on the band can be a conventional bar coding arrangement or other code, and the dashes or lines used can be oriented parallel to the longitudinal direction of the ribbon or parallel to the transverse center line of the band. The lines of index or code marks are in band that extends laterally across the web or ribbon.

The sequence of information marks for example can be the coding arrangement disclosed in U.S. Pat. No. 5,755,519, the contents of which is incorporated herein by reference, insofar as the coding sequence for providing information is concerned. The coding arrangement of providing a "start" segment or indicator at one end of the line of marks on the ribbon, and then code or index sectors in the line to provide identification of the panel frame following, would be linear, laterally across the ribbon, instead of in an annular configuration as shown in U.S. Pat. No. 5,755,519. The present invention permits more information to be coded on the ribbon than prior art devices.

A sensor assembly 50 is utilized in order to read the infrared ink coded information which could represent a number of different types of information, including a start position for identification of the start of the code and the like. Sensor assembly 50 includes a tubular shield housing 52 that is mounted onto the frame of the printer, in a suitable manner such as with a bracket 55. The shield housing 52 has a infrared LED 54 mounted onto the side wall thereof in a suitable location.

The LED 54 extends through the wall of the shield and is focused (a lens can be used if desired) so that a spot of infrared radiation or light indicated at 56 will strike the transverse band of code marks formed in a code band or line 58 between individual frames or panels on the ribbon 12. The infrared ink coding on band 58 is made so that it will luminesce in the spot of radiation or light on the ribbon from the infrared LED 54.

An infrared sensor array of conventional design indicated at 60 is mounted at a suitable location spaced from the web or ribbon 12 but in position so that it will receive reflected light signals from the illuminated infrared ink coding on band 58. The light signals are sensed in sensor cells by the sensor array and normally the array will be able to sense whether there is light or no light in 128 pixels, with a resolution of 400 dpi using a sensor such as Texas Instrument Inc., Part No. TSL 401. The presence or absence of light in the cells or segments sensed will be processed in order to determine the sequence of regions in the code length that are either coated with infrared ink or left plain. The information is digitally decoded so that the color of the next frame on the ribbon is determined. This information is provided to the central printer controller 22.

Figure 4:
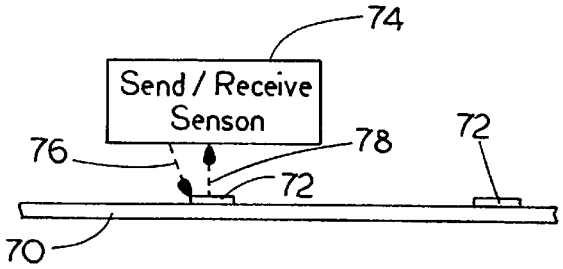
FIG. 4 is a schematic representation of a second form of code sensors.

Referring to FIG. 4, it can be seen that the coding for the ribbon can also be varied to be compatible with different types of sensors. In FIG. 4, a ribbon 70 is illustrated as having white ink or reflective metallic marks or lines 72 thereon, which can be on one of the transverse code bands. A send and receive sensor assembly indicated at 74 provides a light signal directed toward the ribbon as indicated by the line 76, and when a white ink or reflective metallic coded band that extends transversely to the ribbon such as that shown at 72 is sensed, a reflected light beam 78 will be received by the sensor 74 for providing the information that is coded onto this reflective, white ink band. The send/receive light sensors are known in the art.

The color of the panel that is ahead of or that follows the white ink band will be different from the white band that reflects light. Thus, the white ink band can be differentiated from the background and will provide a reflected light signal. Information is coded in the transverse bands using different reflective segments for indicating the color of the panel that is following and other information.

Additionally, information concerning the start of the repeatable sequence of frames is provided, either by the coding of the code line of infrared ink or white ink marks or indicia indicated at 58 or by a separate sensor such as a yellow LED 64 shown schematically in FIG. 2, that would read information relating to the ribbon. The yellow LED indicates when a yellow frame or panel 38 approached the platen 18.

In any event, the information from the card leading edge sensor 32 and the information from the code band or line 58 is used in the printer controller to make sure that the card 24 that is being fed to the platen 18 will be positioned so that it comes under the print head at the proper location relative to the leading color frame on the print ribbon. The printing operation will continue according to the desired program once the card and the ribbon are properly indexed, using the information from the sensor array 60.

Figure 3:
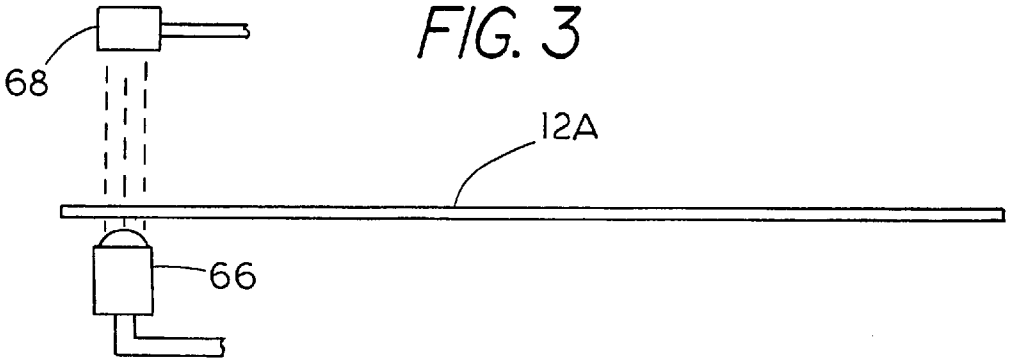
FIG. 3 is a side view of a ribbon with one form of code sensors illustrated schematically.

Instead of having a reflective type of sensing array using an infrared LED 54 above the ribbon, light sources, such as that shown at 66 in FIG. 3 could be on the opposite side of the ribbon or web from that shown. The ribbon 12A in FIG. 3 has a bar code sequence in bands between the color panels or frames, and transmitted light coming through the open spaces in the pattern can be used as a suitable known bar code sensed by the sensing array 68.

When the ribbon or web is manufactured and printed with the marks forming the code in the transverse bands, the web is usually in a wide roll, and then is slit into the individual strips such as that shown at 12. The line of code marks or indicia 58 that is provided on an individual strip would be repeated across the wide ribbon roll at suitable intervals so the there would be a code line 58 on each of the strips. Code marks would thus be present on each of the slit strips when they are removed or separated from the wide supply roll. The identification of the start of the coded sequence of marks of each line of code insures that the sensing array will record the information accurately even if the code line may not be exactly in the same lateral location on each of the strips 12 which are slit from a wide supply roll, due to manufacturing tolerances. The length of the line used for the code is shorter than the width of the ribbon, even though bands or lines 58 are shown as extending across the entire ribbon or web in the drawings.

In place of the supply roll 14 and the take-up roll 16, a ribbon cassette can be used, and such cassette is indicated at dotted lines at 62. It merely mounts the ribbon, the take-up roll and the supply roll in a single housing that can be introduced into the printer easily.

Figure 5:
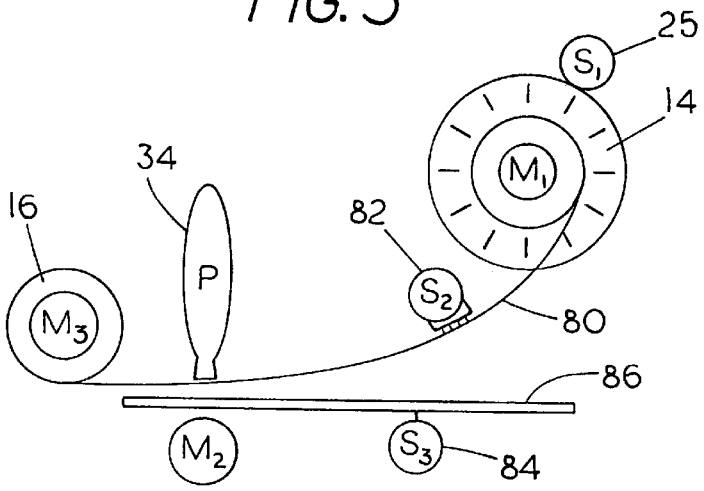
FIG. 5 is a schematic block diagram representation of the ribbon or web drive and control, and sensors used for sensing positions of a card being printed and of the ribbon used.

With the use of a ribbon or web velocity sensor, such as that shown at 25, and also shown schematically in FIG. 5 at 25 and 5, the velocity of the ribbon 80 shown in FIG. 5 can be determined, and with the sensor array 82 or 52 being utilized, the information provided by the sensor 82 from two coded index bands in a sequence can be used to determine the length of each panel of the ribbon. By sensing the velocity, and measuring the elapsed time between the passage of a first band of marks past the sensor 82 (or the other array as shown in the other forms of the invention) and the next band or marks indicating the start of the next panel, the actual length between the bands identifying one or more color panels on the ribbon can be calculated in the controller, which may be a micro-processor. The length as measured can be referenced to the nominal or no tension length of the panels which would be a reference input to the controller so the amount of stretch of the ribbon because of the tension created between the supply roll motor shown at M1 in FIGS. 5 and 6 and the take-up motor M3 shown in FIGS. 5 and 6. The amount of web tension can be regulated by adjusting the torque of motors M1 and M2 to compensate for ribbon stretch. The amount of stretch measured can be used in controlling the ribbon during printing to insure that the full panel of that color is utilized. Knowing the ribbon or web velocity and time of passage of one panel between the sensed transverse index marks also permits compensation of the printer for variations in panel length when the ribbon was manufactured, because it is possible to have a real-time determination of the length of each panel. If a panel of color is longer or shorter than the normal length, the platen for the printhead can be driven so the full panel is moved under the printhead. The platen drive can be adjusted by the controller if the color panel is longer or shorter.

Coordination between the sensor 82 (S2) in FIG. 5, and the card edge sensor (which senses the leading of the card) indicated at 84 (S3) in FIG. 5 and also indicated at 32 with the sensor array 60 in FIG. 1 for locating an index mark band, can be used for precisely indexing the card 86 shown at FIG. 5 with the appropriate leading edge of a color panel or frame or series of color panels on the ribbon 80.

Figure 6:
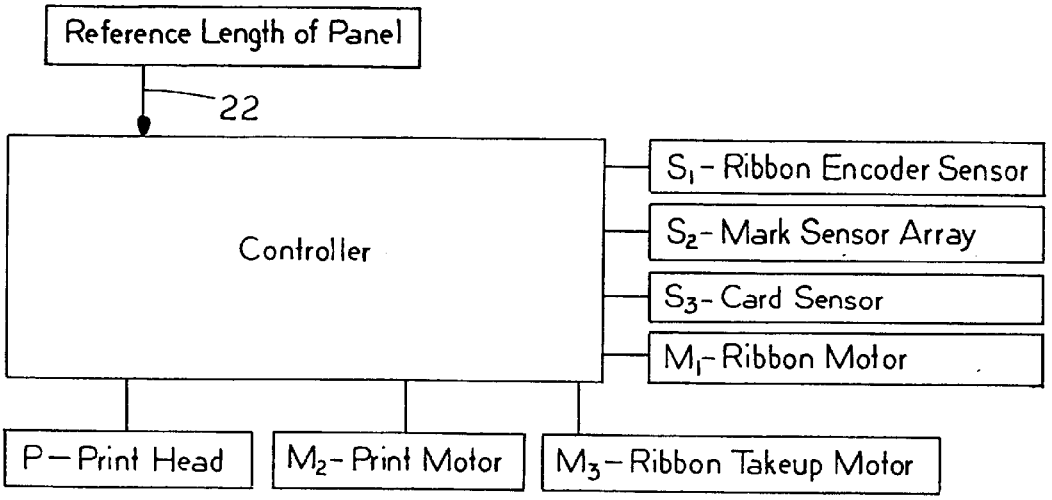
FIG. 6 is a schematic block diagram representation of sensor inputs used with a controller for controlling the various motors and functions of the printer.

As stated previously, the individual colors are also coded differently so that each panel color is identified, and through the controller 22 shown in FIG. 6, the power to the printhead heater (P and 34) along the power control line is adjusted for different densities of colors that are present. For example, orange may be more intense than yellow and thus, requires more power. The controller will provide the power.

The controller 22 will also compensate for ribbon stretch, and can adjust the ribbon tension during operation as desired, depending on ribbon strength as well. The ribbon strength can be determined by the amount of stretch, by again sensing with the sensor 82 the time that it takes for one panel to pass (or one whole series of panels to pass), and the velocity of the ribbon will be known by use of the velocity sensor 25. The velocity sensor 25 will also compensate for the differences in diameter of the ribbon remaining on the supply spool.

Figure 7:
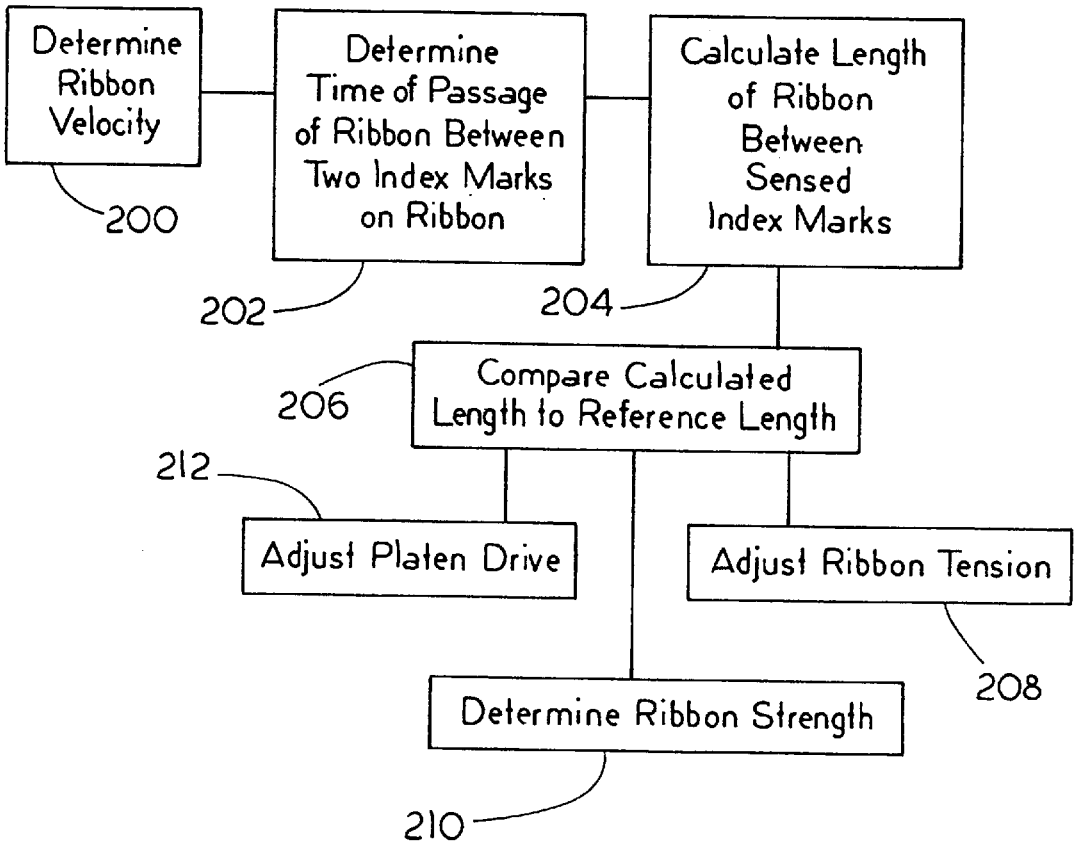
FIG. 7 is a block diagram representation of method of providing ribbon status based on actual length between index marks.

As shown in FIG. 7, the process used for adjusting the driver based upon measured lengths of panels that are available with the index marks of the present invention are illustrated.

The first step is to determine the ribbon velocity as noted in block 200, and then to determine the time of passage of the ribbon between two index marks on the ribbon as shown at 202. This time of passage is measured by an internal clock in the controller 22, which is a micro-processor, and is responsive to a start signal from one of the index marks on the ribbon and a stop signal from another index mark. It should be noted that these index marks do not necessarily have to be only one frame or panel long, but could be several frames if desired for various purposes. Once that measured is done, the micro-processor will calculate the length of the ribbon between the sensed index marks using straight arithmetic process based on time, distance and speed. This is illustrated at block 204.

In block 206, it is shown that there is a comparison of the calculated length between the index marks with a reference length, such as a nominal length provided by the manufacturer, or some other input that is provided as a reference length.

The comparison that takes place at block 206 then can be used for providing an adjustment of the ribbon tension by having controller 22 adjust the motors M1 and M2, and their relative speed as shown at the block 208.

Additionally, the ribbon strength can be determined by calculating the amount of ribbon stretch with some other information such as the thickness of the ribbon and the material of the ribbon, as shown at block 210, or the platen drive speed and length of film driven can be adjusted as shown at block 212 so that with the knowledge of the actual length of the ribbon color panel or frame, the amount of movement of the color panel under the printhead, as a result of movement of the platen can be adjusted to make sure that the entire color panel is utilized for printing, even if the panel is stretched, or is slightly smaller than normal. This can be done individually by each color panel. Alternatively, ribbon tension can be sensed and used for adjustment.

Figure 8:
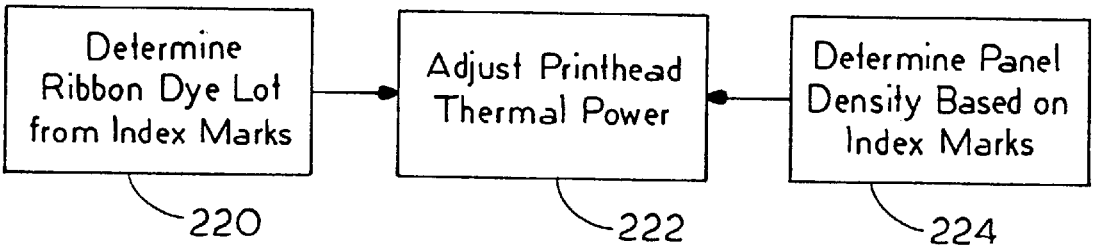
FIG. 8 is a block diagram showing control of thermal printhead power based on ribbon dye status.

Additionally, as shown in FIG. 8, the process of adjusting the printhead thermal power or heater power is shown, and it includes determining the ribbon dye lot from the index marks as indicated at block 220 and then adjusting the thermal power to the printhead as shown at block 222. This adjustment also can be based upon a determination of the panel color density based on the index marks as shown by block 224, which would then be used for adjusting the printhead thermal power as well.

The methods thus can be used for real time adjustment of the printhead power based upon the color that is being printed at a particular time.

The description has been simplified to show how a laterally extending code line of marks permits a wide variety of information to be provided, but other arrangements can be used. The inks that can be used for providing the code line 58 can be inks that will fluoresce at a different frequency than other inks. Thus the code lines can be formed of several different frequency sensitive inks and a sensor using selected frequency light will respond to a particular ink, so identification of the frames can be by detecting the frequency at which the ink fluoresces. Thus each different frequency response could show a different location.

The use of the laterally extending bands or lines of code marks permits a wide variety of combinations of indicators. The lines can be frame indicators only with a separate sensor for the start of each sequence; the lines can be coded for indicating a frame and the start of the repeating frame sequence and have a separate indicator code for such a frame sequence start signal; a separate sensor can be used for the start of each frame and the transverse code line used for indicating a start of the repeating sequence only; or a separate sensor can be used to indicate the start of the repeating sequence and each frame can be coded as to its individual color using the transverse line of code marks.

The code information can be processed by the controller 22 so the proper colors are used for printing on the card or substrate, such as paper. Other uses of coded information include verifying that the correct ribbon is installed for the current print job or that the correct ribbon is installed for a specific printer. Further, the leading band of marks can provided information to indicate that the ribbon is inserted in the printer correctly and is not reversed or upside down or backwards.

The coding disclosed allows slitting the wide ribbon with no waste since no side edge portion of the ribbon is needed for coding or index marks. Also, accuracy is enhanced with the present invention since the sensing system senses each frame before it is used for printing.

Although the present invention has been described with reference to preferred embodiments, workers skilled in the art will recognize that changes may be made in form and detail without departing from the spirit and scope of the invention.

What is claimed is:

1. A printer for printing images on a substrate, comprising a rotatable platen for receiving and moving a substrate therewith; a print head adjacent the platen and selectively operable to print images on the substrate; a movable web with a series of frames of different colors of transferable material arranged in a repeated sequence, said web having discrete index marks thereon indicating boundaries between adjacent frames, the discrete index marks being arranged in a series of a plurality of separately identifiable discrete and adjacent index marks along a line extending in a direction laterally across the web; a sensor for sensing and identifying the index marks as the web moves as guided by the platen and a controller; said controller receiving signals indicating the velocity of the web passing through the printer, and the sensor sensing the time for passage of selected ones of the index marks indicating boundaries correlated with the velocity of the web, to determine the length between selected boundaries on the ribbon, the controller determining the web stretch and panel length variation by comparing the determined length to a nominal length between the same selected boundaries.

2. The printer of claim 1, wherein the index marks are printed on the web with infrared sensitive ink, and the sensor comprises an infrared light source and a receiver for receiving light reflected from the marks.

3. The printer of claim 1, wherein the index marks include a mark indicating a start position.

4. The printer of claim 1, wherein said index marks comprise a strip across the ribbon including white portions to permit sensing with a light source and reflected light sensor on one side of the ribbon.

5. The printer of claim 1 and a second sensor for sensing the position of a substrate on which printing is to occur, and a controller for receiving the information from the sensor sensing index marks and the second sensor for sensing the substrate position, and controlling motors for driving the substrate and the web for registering the substrate relative to one of the lines of index marks on the web.

6. The printer of claim 1, wherein said ribbon includes a line of index marks indicating a ribbon lot code.

7. The printer of claim 1, wherein the printer is a thermal printer having a heated printhead, said web has a plurality of different colored panels separated by lines of index marks, and wherein the web includes a line of index marks indicating characteristics of the color panels on the web, and a controller including a thermal control to the printhead, said controller adjusting the thermal control to the printhead as a function of the signal received indicating the dye set of the ribbon.

8. The printer of claim 1, wherein the printer is a thermal printer having a thermal printhead, the web being a thermal color print web, said lines of index marks identify individual colors of panels following the index marks, and a controller to receive the signal indicating the color of an associated panel, and connected to the printhead to adjust a power supply to the printhead to coordinate it with a particular color indicated by the index marks for that associated panel.

9. The printer of claim 1, wherein the printer is a printer using a resin color ribbon, the web being a resin color print web, said lines of index marks identify individual colors of panels following the index marks, and a controller to receive the signal indicating the color of an associated panel, and connected to the printhead to adjust a power supply to the printhead to coordinate it with a particular color indicated by the index marks for that associated panel.

10. The printer of claim 1, wherein the printer is a thermal printer having a controllable power thermal printhead, the web being a dye sublimation print ribbon, and wherein the index marks are separate for individual frames of different color panels on the ribbon, and a controller connected to receive signals indicating the colors of panels as identified by the index marks, said controller being connected to the thermal printhead to set the level of power to the thermal printhead for each individual color identified.

11. The printer of claim 1 wherein the index marks indicate a start position and whether the ribbon is installed incorrectly.

12. The method of determining an actual length of a portion of a printer ribbon having index marks at spaced locations along the length of the ribbon and driven in a longitudinal direction, comprising determining the velocity of the ribbon as it moves in the longitudinal direction, determining the time of passage of a ribbon length between selected index marks as the ribbon moves in the longitudinal direction, correlating the velocity signal with the time of passage between said selected index marks to determine the length of the ribbon between the index marks as it is moving in the longitudinal direction, comparing the length as determined with a reference nominal length between the index marks.

13. The method of claim 12 including correlating the length as determined for the strength of the ribbon based upon changes from the length determined and the reference length.

14. The method of claim 12, and adjusting the tension in the ribbon by regulating motors driving supply and take-up spools on which the ribbon is mounted.

15. The method of claim 12 including adjusting the duration of operation of the printer to printing along the ribbon length determined.

16. A printer for printing images on a substrate, comprising a rotatable platen for receiving and moving a substrate therewith; a print head adjacent the platen and selectively operable to print images on the substrate; a movable web with a series of frames of different colors of transferable material arranged in a repeated sequence, said web having discrete index marks thereon indicating boundaries between adjacent frames, the discrete index marks being arranged in a series of a plurality of separately identifiable discrete and adjacent index marks along a line extending in a direction laterally across the web; a sensor for sensing and identifying the index marks as the web moves as guided by the platen and a controller; said controller receiving signals indicating the velocity of the web passing through the printer, and the sensor sensing the time for passage of selected ones of the index marks indicating boundaries correlated with the velocity of the web, to determine the length between selected boundaries on the ribbon, the controller determining the web strength by comparing the determined length to a nominal length between the same boundaries.

* * * * *